US008662252B2

(12) United States Patent
Ogden

(10) Patent No.: US 8,662,252 B2
(45) Date of Patent: Mar. 4, 2014

(54) LEVELING SYSTEM FOR PORTABLE WORK PLATFORMS

(75) Inventor: David Ogden, Pocahontas, IL (US)

(73) Assignee: David Kirk Ogden, Pocahontas, IL (US)

( * ) Notice: Subject to any disclaimer, the term of this patent is extended or adjusted under 35 U.S.C. 154(b) by 0 days.

(21) Appl. No.: 12/455,756

(22) Filed: Jun. 6, 2009

(65) Prior Publication Data

US 2010/0012430 A1 Jan. 21, 2010

Related U.S. Application Data

(60) Provisional application No. 61/131,228, filed on Jun. 6, 2008.

(51) Int. Cl.
*E06C 7/00* (2006.01)

(52) U.S. Cl.
USPC ..... 182/115; 182/17; 182/107; 248/188.5; 280/79.11

(58) Field of Classification Search
USPC ..... 182/107, 108, 109, 111, 117, 118, 119, 182/17; 280/35, 79.11; 248/132, 165, 188, 248/188.8, 188.5
See application file for complete search history.

(56) References Cited

U.S. PATENT DOCUMENTS

| | | | | | |
|---|---|---|---|---|---|
| 650,900 | A | * | 6/1900 | Knopfe | 52/126.7 |
| 771,878 | A | * | 10/1904 | Laughlin | 182/69.6 |
| 2,798,652 | A | * | 7/1957 | Easton | 182/17 |
| 2,961,250 | A | * | 11/1960 | Beach | 280/35 |
| 3,331,613 | A | * | 7/1967 | Popelka | 280/35 |
| 3,463,265 | A | * | 8/1969 | Clover | 182/17 |
| 3,752,261 | A | * | 8/1973 | Bushnell, Jr. | 182/17 |
| 3,871,477 | A | * | 3/1975 | Kuest | 182/69.4 |
| 4,000,789 | A | * | 1/1977 | Zahner | 182/152 |
| 4,216,933 | A | * | 8/1980 | Cramer, Jr. | 248/188.5 |
| 4,390,080 | A | * | 6/1983 | Bushnell, Jr. | 182/115 |
| 4,392,436 | A | * | 7/1983 | Weiler | 108/81 |
| 5,022,490 | A | * | 6/1991 | Wyse | 182/17 |
| 5,069,309 | A | * | 12/1991 | Swiderski et al. | 182/119 |
| 5,121,812 | A | * | 6/1992 | Ochiai et al. | 182/152 |
| 5,228,534 | A | * | 7/1993 | Haroldson, Sr. | 182/63.1 |
| 5,474,151 | A | * | 12/1995 | Yonahara | 182/152 |
| 5,819,872 | A | * | 10/1998 | Krause | 182/17 |
| 5,860,489 | A | * | 1/1999 | Krause | 182/17 |
| 6,053,284 | A | * | 4/2000 | Fountain | 182/180.2 |
| 6,095,533 | A | * | 8/2000 | Balolia | 280/35 |
| 6,520,460 | B2 | * | 2/2003 | Hallberg et al. | 248/188.5 |
| 6,863,155 | B2 | * | 3/2005 | Wyse et al. | 182/118 |
| 7,438,301 | B2 | * | 10/2008 | Schilling et al. | 280/79.7 |
| 7,828,116 | B2 | * | 11/2010 | Vetesnik | 182/18 |

* cited by examiner

*Primary Examiner* — Katherine Mitchell
*Assistant Examiner* — Colleen M Chavchavadze

(57) ABSTRACT

A carriage assembly includes a carriage frame, a caster, and a first jack body coupled to the carriage frame and the caster. The first jack body has a longitudinal axis. The first jack body is configured to selectively move the caster with respect to the carriage frame along the longitudinal axis.

18 Claims, 6 Drawing Sheets

"An Isometric View of Jack Assembly"

"An Isometric View of Jack Assembly"

"An Isometric View of Jack Assemblies as inserted into Carriage"

"An Oblique View of Leveling System upon Irregular Terrain"

"A Orthographic View of Leveling System upon Irregular Terrain"

"An Isometric Detail View of Platform Elements and their Engagement"

"A Partially Exploded Isometric View of Work Platform and Leveling System"

LEVELING SYSTEM FOR PORTABLE WORK PLATFORMS

This application for a utility patent is a conversion of Provisional Application 61/131,228.

BACKGROUND OF THE INVENTION

It is common practice for persons in construction, building, and maintenance trades to use work platforms and scaffolding to access elevated work areas. The safety and productivity of workers using these portable work platforms or scaffolds requires that the platforms or scaffolds be physically stable, be easy to position, be substantially level, and be readily moved from place to place.

The majority of portable work platforms or scaffolds currently in use in the construction and maintenance trades are supported by four legs or points of contact with the ground (i.e., support elements). In some instances, these legs are to be fitted with stem casters to facilitate relocation between workplaces.

The ground or floor surface at many construction sites and other work locations is often irregular and uneven. In current field practice, significant time and effort may be required to level the scaffolding by placing wooden blocks or other cribbage under the platform support legs, wheels, or casters. It is common for many portable scaffolds, such as those fitted with wheels, to be inadequately blocked or leveled due to the unavailability of proper cribbage and/or hasty installation.

Often the best points of support (i.e., solid, level surfaces) for a work platform do not correspond with the location of the work platforms vertical support elements. This requires the users to either move the platform to a less than ideal location to perform the overhead task, or tolerate an unstable (and often unsafe) work platform.

It is common practice for existing scaffolding to be constructed from tubular structural members. However, the geometry of traditional tubular scaffolding members provide high load bearing capacities, but do not provide torsional rigidity. As a result, traditional scaffolding must be fitted with diagonal braces. However, diagonal braces often interfere with tasks such as painting, tuck pointing or other maintenance or construction activities.

In many applications the use of scaffolding or work platforms could enable workers to perform their tasks more efficiently and safely than is possible working from an extension or step ladder. However, the use of scaffolding may be limited because, in most application, traditional scaffolding is too large or cumbersome to fit through a narrow door way or similar obstruction. As such, valuable work time is often wasted ascending, descending, and/or repositioning ladders.

BRIEF SUMMARY OF THE INVENTION

In one aspect, a carriage assembly is provided. The carriage assembly includes a carriage frame, a caster, and a first jack body coupled to the carriage frame and the caster. The first jack body has a longitudinal axis. The first jack body is configured to selectively move the caster with respect to the carriage frame along the longitudinal axis.

In another aspect, a carriage assembly is provided. The carriage assembly includes a carriage frame that includes a first frame member having a first axis. A first jack body is coupled to the first frame member and a caster. The first jack body has a longitudinal axis that is substantially perpendicular to the first axis. The first jack body is configured to selectively move the caster with respect to the carriage frame along the longitudinal axis.

In yet another aspect, a carriage assembly is provided. The carriage assembly includes a carriage frame that includes a first frame member defining a first receiver opening. The first frame member has a first axis. A first jack assembly includes a jack attachment member sized to fit within the first receiver opening such that the first jack assembly is movable along the first axis. A jack body is coupled to the jack attachment member. A foot includes a caster and a shaft extending from the caster. The jack body defines a jack opening. The jack body has a longitudinal axis. The shaft is sized to fit within the jack opening. The first jack body is configured to selectively move the caster with respect to the carriage frame along the longitudinal axis.

Figure 1:
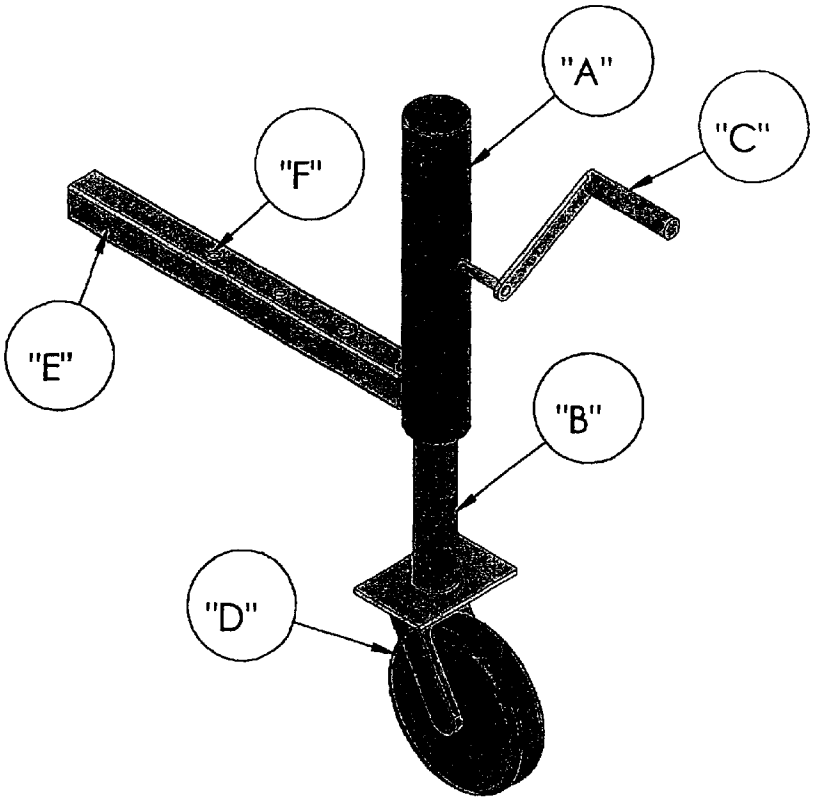
FIG. 1—An isometric assembly drawing that depicts a unique and original arrangement of a stabilizing jack, a locking caster, and perforated mounting tube.
Figure 2:
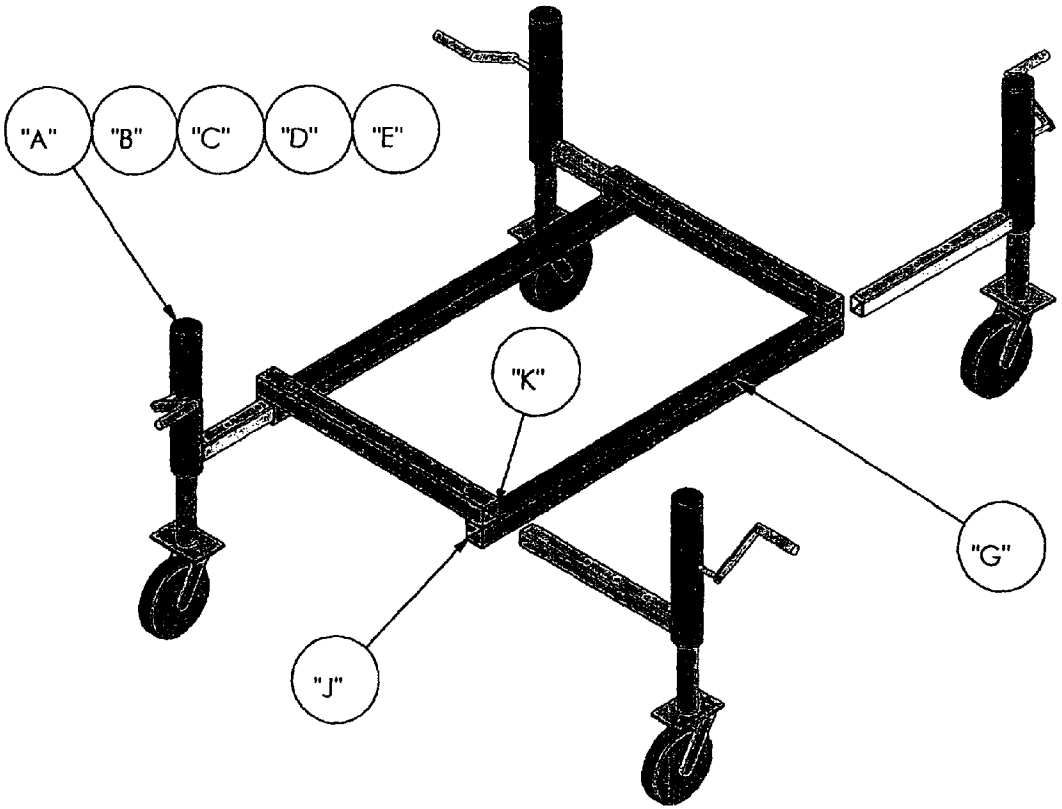
FIG. 2—An isometric assembly drawing depicting a carriage framework intended to support a scaffold or work platform. In addition, (four) mechanical jack assemblies, as detailed in Drawing 1, are depicted in various states of attachment or insertion into the carriage.
Figure 3:
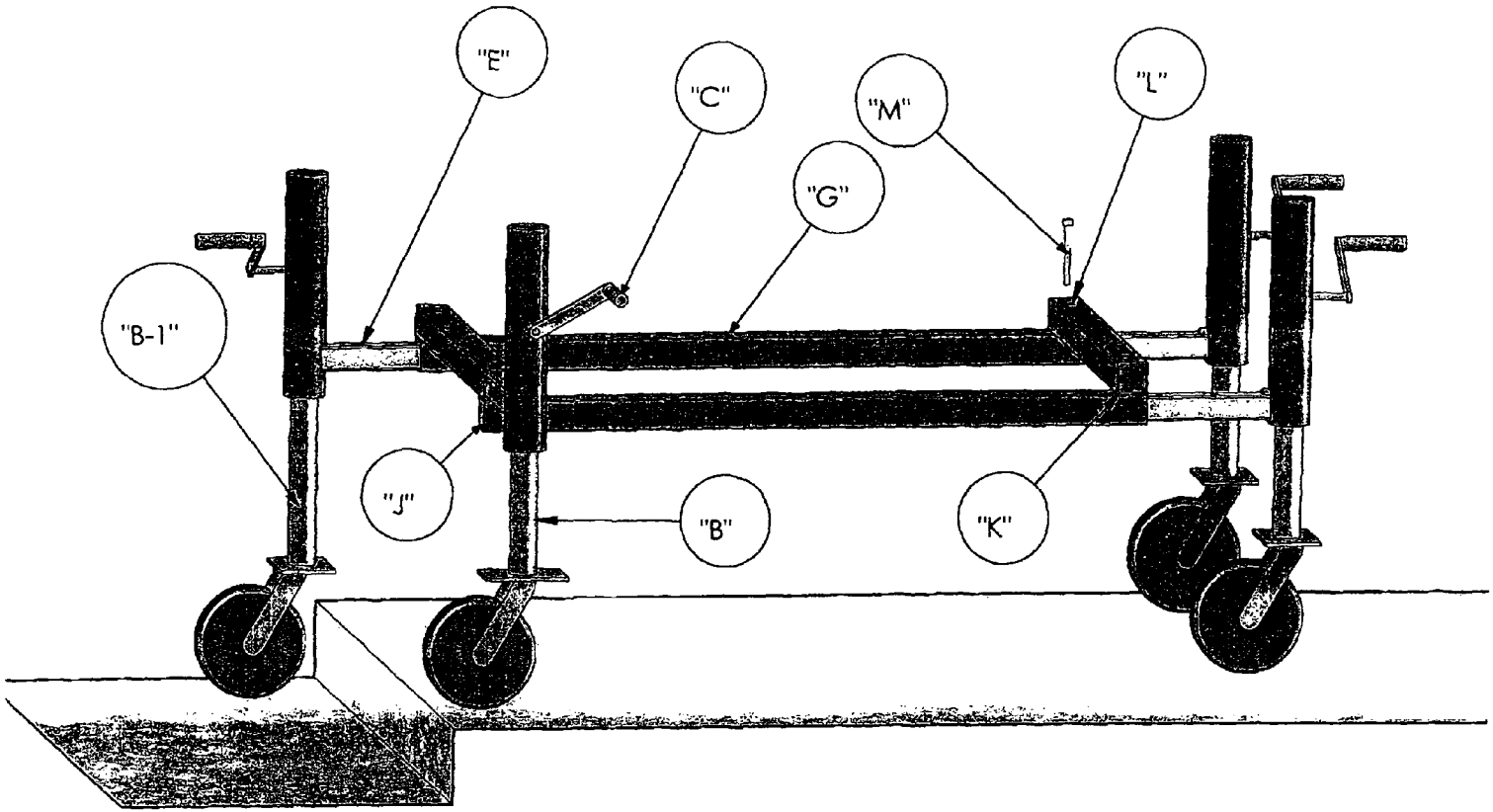
FIG. 3—An oblique view drawing depicting a scaffold or work platform carriage and claimed leveling system, and depicting the claimed system's ability to compensate for irregularities in the environmental terrain or floor upon which it is transported or supported.
Figure 4:
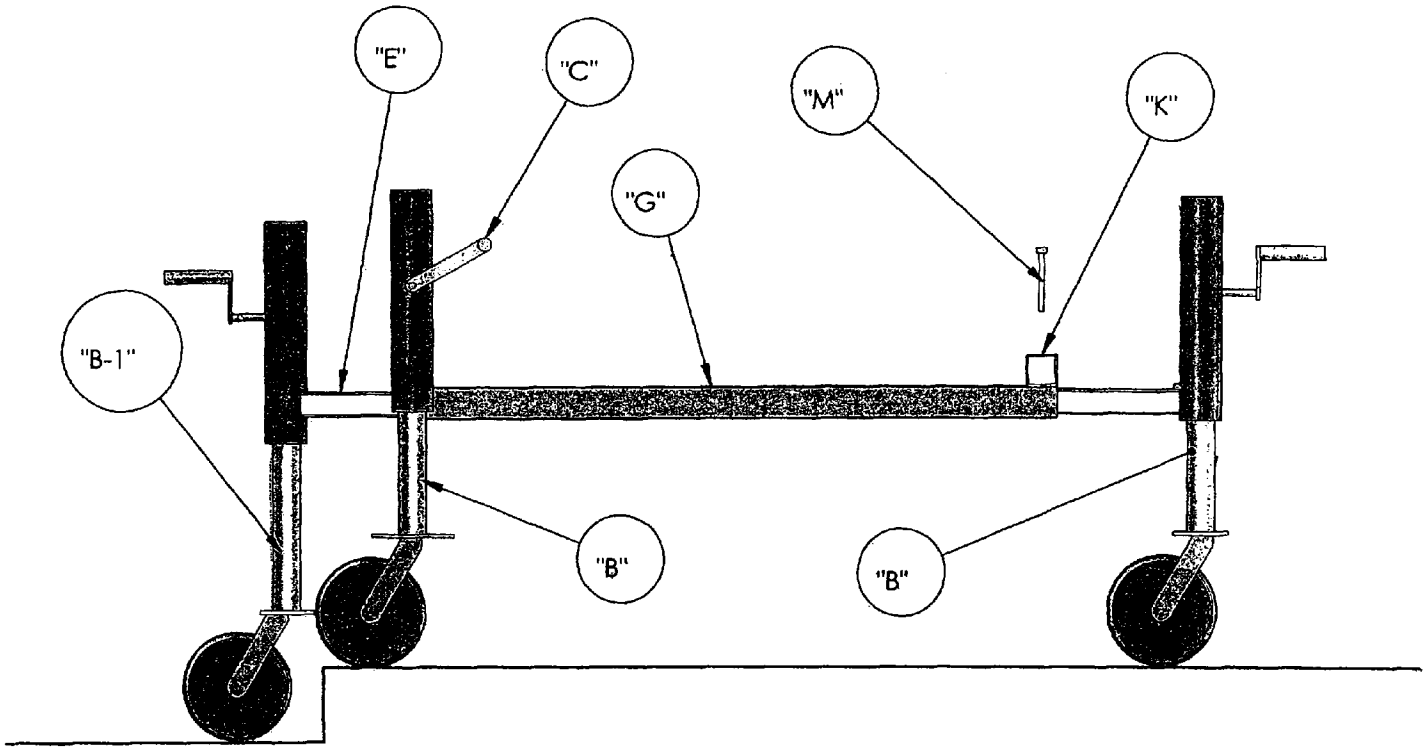
FIG. 4—A front view drawing detailing a scaffold or work platform carriage and claimed leveling system, and depicting the claimed system's ability to compensate for irregularities in floor elevation or ground conditions.
Figure 5:
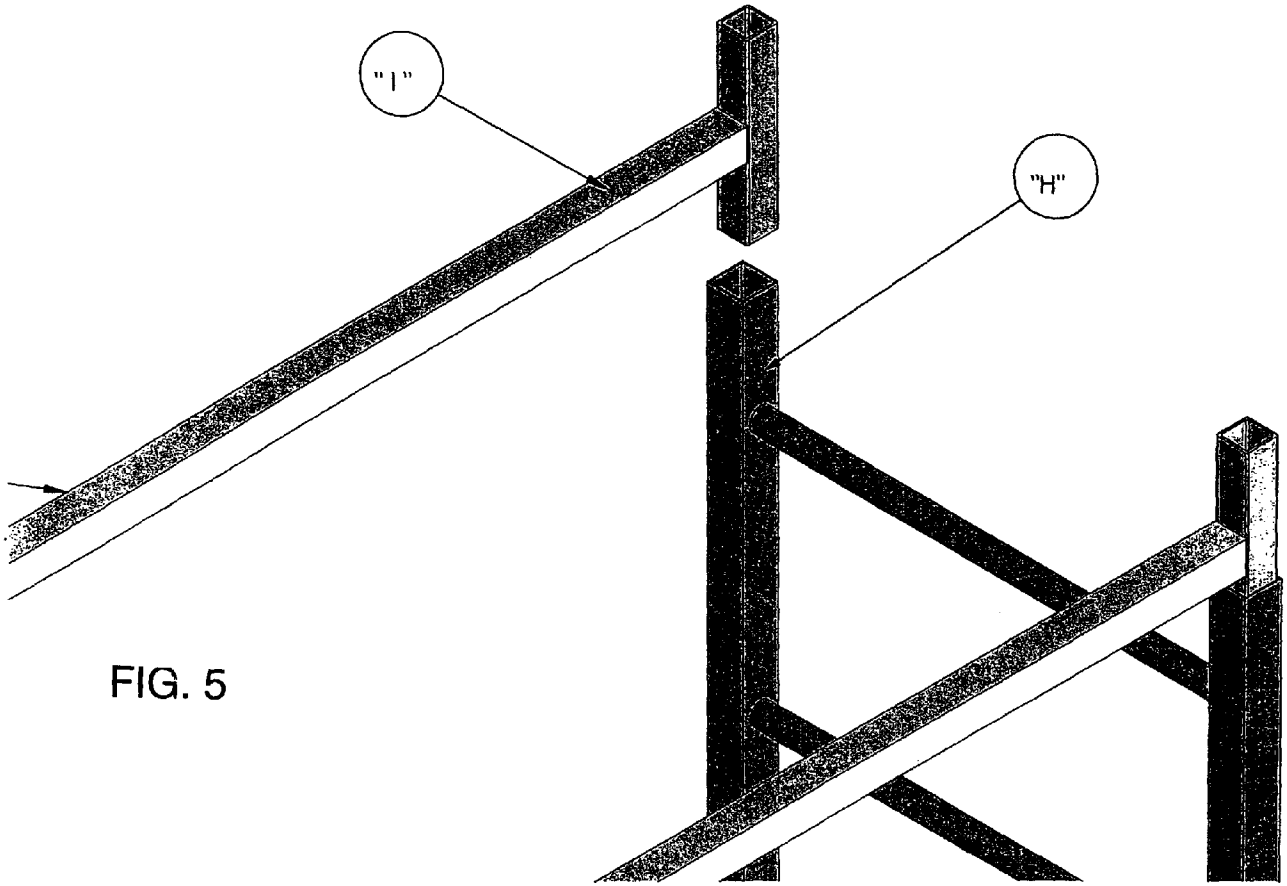
FIG. 5—An isometric assembly drawing depicting the claimed scaffold or work platform, carriage, and leveling system.
Figure 6:
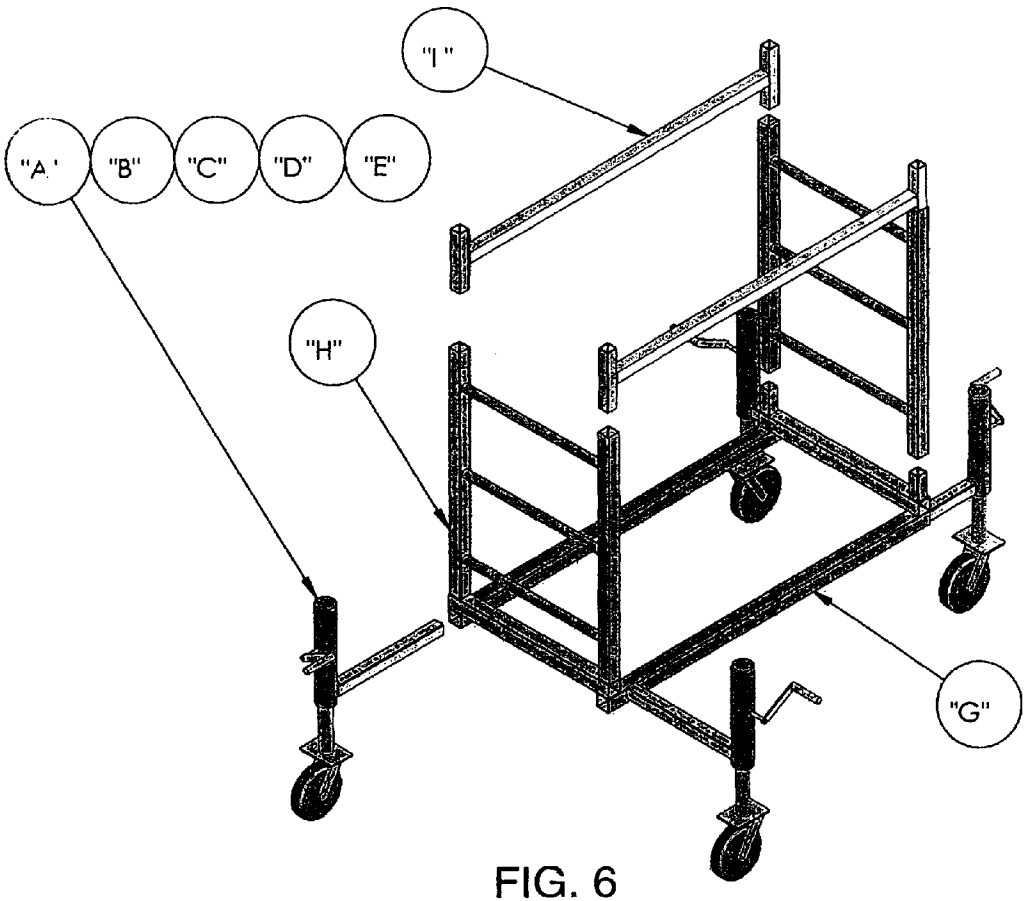
FIG. 6—An isometric assembly detail drawing depicting the claimed engagement of square and rectangular tube elements.

Item A—The jack body or stationary portion of a typical stabilizing jack, such as those often used to support or lift the tongue of an automotive trailer. (See note below)

Item B—The telescoping foot of a typical stabilizing jack assembly, such as those often used to support of lift the tongue of an automotive trailer.

Item C—The hand crank as typically rotated by the user to raise or lower a stabilizing jack, with major components depicted in entirety as items A, B, and C.

Item D—A typical commercially available fully locking floor caster. When activated by the user, the casters integral brake prevents rotation of both the wheel as well as rotation of the caster.

Item E—A jack attachment tube consists of a length of commercially available steel or aluminum box tube as extruded in a square or rectangular hollow profile.

Item F—Locating holes or similar through perforations as punched or drilled through item E which allows the insertion of pins or similar retaining hardware.

Item G—A carriage which supports the work platform which is fabricated from commercially available steel or aluminum box tube as extruded in a square or rectangular hollow profile.

Item H—Modular, interchangeable H members constructed from square or rectangular tubing which form the vertical elements and ends of the portable scaffold or work platform.

Item I—Modular, interchangeable I members constructed from square or rectangular tubing which form the vertical elements and sides of the portable scaffold or work platform.

Item J—Receivers or similar openings at each end and on the major axis of the carriage, G.

Item K—Receivers or similar openings at each side and on the minor axis of the carriage, G.

Item L—Locating holes or similar through perforations as punched or drilled through the carriage, G which allows the insertion of pins or similar retaining hardware.

Item M—A commercially available retaining pin, which could be a hitch pin, device pin, spring pin or similar common means of attachment.

Note: The stabilizing jack (items A, B, and C), locking caster (item D), and retaining pin (item L) depicted herein are common, commercially available components. These items are not claimed, but rather their use in part of a unique and original combination which, when incorporated together with other depicted components, provides an improved method of leveling and stabilizing portable work platforms.

DETAILED DESCRIPTION OF THE INVENTION

It is common and accepted practice in the building, maintenance, and construction trades to use portable work platforms or scaffolds to perform tasks in elevated locations.

It is common for the floor, ground surface, or other environmental terrain of many construction and maintenance sites to be irregular, rough, or strewn with debris or other errant, random objects.

It is desirable that workers engaged in construction and maintenance trades be able to readily move portable scaffolds or work platforms from one location to another in order to expeditiously perform various tasks at various locations.

It is common and accepted current practice to fit wheels and stem casters to the vertical members of certain existing, commercially available scaffolds and work platforms to accommodate locomotion as outlined above.

It is advantageous that those engaged in various construction and maintenance trades be provided with portable scaffolds and work platforms which are more stable than those currently commercially available through an improved and more versatile means of leveling and supporting such work platforms.

The Applicant claims a substantial improvement over the current art and practice of manufacturing and configuring portable scaffolds and work platforms is achieved when certain jack, caster, and other commercially available components are combined in his unique and original modular work platform as described herein.

Feature 1 provides convenient movement of the portable scaffold or work platform between work sites upon locking caster wheels.

Feature 2 readily changes or adjusts the position of each point of support of the portable scaffold so to improve access and transit through narrow doorways, aisles, or other physical obstacles.

Feature 3 readily changes or adjusts the position of each point of support of the portable scaffold so to optimize or improve platform stability.

Feature 4 provides hand-operated jacks to compensate for variations in floor elevation or obstructions beneath the portable scaffold or work platform.

Feature 5 provides an interlocking structural design to allow relocation of each individual point of support without requiring scaffold disassembly or causing the platform to tip or become temporarily unstable.

Feature 6 eliminates the need for diagonal supports which obstruct and interfere with tasks being performed by users of the portable scaffold or work platform.

Feature 7 provides a simple and reliable method of dismantling and reassembling the portable scaffold or work platform for compact transportation or storage.

Please reference Drawing One which depicts a typical, commercially available stabilizing jack assembly consisting of three principle external components; a fixed body A, a telescoping member B, and a hand crank C. A commercially available locking floor caster, D, is bolted or similarly attached to the lower, telescoping portion of the stabilizing jack B.

Feature 1 provides convenient movement of the portable scaffold or work platform is achieved by combining the jack assembly (sum of items A, B, and C) with that of the locking floor caster, item D, as described above.

The benefit of improved platform stability as described above is enhanced by incorporation of the locking feature commonly found on certain commercially available locking floor casters, D. Locking floor casters are integrated with the jack assemblies as described above. This feature allows the user to set the caster brakes when at the desired work location. Upon completing the task, the user releases the caster brake to facilitate rolling the entire work platform to another desired location.

The body of the stabilizing jack A is welded, or similarly securely joined, to a length of steel box tube or similar square or rectangular structural material to provide a jack mounting tube which is depicted as item E.

Each jack mounting tube, E is perforated on its vertical axis through both faces of the square or rectangular tubing. These perforations, depicted as item F are located at one or more locations along the length of the jack mounting tube. In Drawing One, the perforations F are depicted at three locations on each jack mounting tube E.

Please reference Drawing Two which depicts a carriage as item G. The carriage frame is fabricated from steel box tube or similar hollow rectangular or square tubing in such a manner that openings, or receivers as depicted as items J and K are located at each corner of the carriage, G. Item J receivers are located on the major axis of the carriage while item K receivers are located on the minor axis of the carriage.

A running fit is formed between the internal opening of each receiver, J and K and the outside faces of each jack mounting tube, item E, thus allowing the engagement of a jack mounting tube E into any desired receiver J or K.

Feature 2 readily changes or adjusts the position of each point of support of the portable scaffold or platform so as to improve access and transit through narrow doorways, aisles, or other physical obstacles is achieved when the user elects to insert the jack mounting tubes E into the major axis receivers K in the method as described above. Thus configured by the user, the portable scaffold assumes a narrow profile and is easily maneuvered through a narrow doorway or aisle.

Feature 3 readily changes or adjusts the position of each point of support of the portable scaffold so to improve platform stability is achieved when the user elects to insert the jack mounting tubes E into the minor axis receivers K in the method as described above. Thus configured by the user, the portable scaffold assumes a wide profile and provides the stability required by workers to safely ascend the platform.

Feature 4 provides an advantage to compensate for variations in floor elevation or obstructions beneath the portable scaffold or work platform. For example, in an environment of irregular clutter, mud holes, or other random obstacles, the user may choose to insert the E portion of certain jack assemblies into any combination of receivers J and/or K which correspond with those areas perceived by the user to offer the best support.

Drawing Three provides an oblique view of a configuration of the claimed work platform in which the telescoping portion of a stabilizing jack assembly B–1 has been retracted by the user to compensate for an obstacle while the remaining jack assemblies B remain in an extended configuration.

Drawing Four provides a front view of a configuration of the claimed work platform in which the telescoping portion of a stabilizing jack assembly B–1 has been retracted by the user to compensate for an obstacle while the remaining jack assemblies B remain in an extended configuration.

The carriage, G, is perforated on a vertical axis with through holes L at points adjacent to each major axis receiver J, and each minor axis receiver K. These holes lie on a shared centerline with the jack attachment tubes, E.

After inserting a jack attachment tube E at a desired location as described above, the user inserts a retaining pin L to secure the jack attachment tube E, and assure platform stability.

In summary, the user may elect to readily adjust the elevation of each corner of the portable scaffold or work platform by rotating the jack hand crank C and readily adjust the location of support for the platform by selecting an appropriate receiver] and/or K into which to insert each jack attachment tube, E.

It is common and accepted practice for existing, commercially available scaffolds and portable work platforms to be fitted with stem casters or wheels. However, these casters cannot be readily removed or relocated unless the scaffolding is disassembled.

Feature 5 allows relocation of each individual point of support without requiring scaffold disassembly or causing the platform to tip or become temporarily unstable is achieved by a user procedure as described in more detail below.

Assuming jack assemblies positioned in locations as depicted in Drawing Four, the operator may wish to remove and relocate the south stabilizing jack assembly. The user would operate the hand crank C on the north jack assembly so as to retract the telescoping foot B.

Following retraction of the north jack assembly as described above, the weight of the portable scaffold or work platform is primarily upon the east and west jack assemblies.

The operator may then elect to remove the retaining pin M on the south jack assembly and withdraw the jack assembly and jack attachment tube E from the receiver.

The operator may insert the jack attachment tube E into the adjacent receiver K on carriage G. The operator subsequently reinserts retaining pin M through perforation L.

Following the procedures outlined above, the user may elect to adjust the elevations of the north and south jacks until the desired platform level is achieved.

Alternatively, the operator may elect to repeat the relocation procedure as described above at one or more of the remaining corners of the carriage G until the desired balance, stability and/or width of the platform is achieved.

It is the current and accepted practice to utilize round tubing as the primary structural elements in commercially available scaffolding and work platforms. While round steel pipe is typically less expensive than similar gauge square or rectangular tubing, round tubing does not provide the torsional rigidity when inserted within another tube as can be obtained by two intersecting lengths of square tubing.

Please reference Drawing Five. Scaffolding components are assembled to the carriage to form a useful work platform. The ends of the platform include H-members as depicted as item H. The horizontal elements of the platform are comprised of cross members as depicted as item I.

The engagement of the claimed square or rectangular geometry of the mating areas of H-members H with the square or rectangular geometry or the mating areas of cross members I, and carriage G provides a substantial increase in torsional rigidity to the assembled platform.

Feature 6 eliminates diagonal supports which obstruct and interfere with tasks is realized by the utilization of square and rectangular elements as described above in lieu of round tubing as is the current practice and described above.

Feature 7 provides a simple and reliable method of dismantling and reassembling the portable scaffold or work platform for compact transportation or storage is realized by the use of modular, interchangeable components and interlocking design.

The invention claimed is:

1. A carriage assembly comprising:

a scaffold;

a carriage frame for supporting the scaffold, the carriage frame consisting of four tubular frame members, wherein the tubular frame members are arranged and connected at their terminal ends such that they form a rectangular frame, wherein each end of each frame member has an open port for receiving a jack body, such that each corner of the rectangular frame consists of a first port oriented in a first direction and a second port oriented in a second direction that is substantially perpendicular to the first direction, wherein the first port and the second port have a substantially similar configuration;

a caster; and a first jack body coupled to said carriage frame and said caster, said first jack body having a longitudinal axis, said first jack body configured to selectively move said caster with respect to said carriage frame along the longitudinal axis to enable a height of said carriage assembly to be selectively adjusted, wherein said first jack body is interchangeably coupleable to said first port and to said second port to enable a length of said carriage assembly and a width of said carriage assembly, respectively, to be selectively adjusted without requiring the scaffold to be disassembled from the carriage frame.

2. A carriage assembly in accordance with claim 1, wherein one of said tubular frame members of the carriage frame defines a first axis, said first jack body movable along the first axis.

3. A carriage assembly in accordance with claim 2 further comprising a second jack body coupled to said carriage frame, a second of said tubular frame members defining a second axis, said second jack body movable along the second axis.

4. A carriage assembly in accordance with claim 1 further comprising a crank coupled to said first jack body, said crank configured to adjust an elevation of said caster with respect to said carriage frame.

5. A carriage assembly in accordance with claim 1 the scaffold further comprising at least one scaffolding member coupled to said carriage frame.

6. A carriage assembly comprising:

a scaffold;

a carriage frame for supporting the scaffold, the carriage frame consisting of four tubular frame members, wherein the tubular frame members are arranged and connected at their terminal ends such that they form a rectangular frame, wherein each end of each of the frame members has an open port for receiving a jack body, such that each corner of the rectangular frame consists of a first port oriented in a first direction and a second port oriented in a second direction substantially perpendicular to the first direction, a first of the frame members having a first axis, and a second of the frame members having a second axis that is substantially perpendicular to the first axis, wherein the second frame member is directly coupled to said first frame member, and wherein the open ports each have a substantially similar configuration;

a caster; and a first jack body coupled to said first frame member and said caster, said first jack body having a longitudinal axis that is substantially perpendicular to the first axis, said first jack body configured to selectively move said caster with respect to said carriage frame along the longitudinal axis to enable a height of said carriage assembly to be selectively adjusted, wherein said first jack body is interchangeably coupleable to the port of said first frame member and to the port of said second frame member to enable a length of said carriage assembly and a width of said carriage assembly, respectively, to be selectively adjusted without requiring the scaffold to be disassembled from the carriage frame.

7. A carriage assembly in accordance with claim 6 further comprising a second jack body coupled to said second frame member such that said second jack body is movable along the second axis.

8. A carriage assembly in accordance with claim 6 further comprising a crank coupled to said first jack body, said crank configured to adjust an elevation of said caster with respect to said carriage frame.

9. A carriage assembly in accordance with claim 6 the scaffold further comprising at least one scaffolding member coupled to said first frame member.

10. A carriage assembly comprising:

a scaffold;

a carriage frame for supporting the scaffold, the carriage frame consisting of four tubular frame members, wherein the tubular frame members are arranged and connected at their terminal ends such that they form a rectangular frame, wherein each end of each of the frame members has a receiver opening for receiving a jack body, such that each corner of the rectangular frame consists of a first receiver opening oriented in a first direction and a second receiver opening oriented in a second direction substantially perpendicular to the first direction, wherein each of the receiver openings have a substantially similar configuration, a first of the frame members having a first axis, and a second of the frame members having a second axis that is substantially perpendicular to the first axis, wherein the second frame member is directly coupled to said first frame member; and a first jack assembly that comprises a jack attachment member sized to interchangeably fit within the first receiver opening and within the second receiver opening such that said first jack assembly is movable along the first axis and along the second axis, respectively, a jack body coupled to said jack attachment member, and a foot comprising a caster and a shaft extending from said caster, said jack body defining a jack opening, said jack body having a longitudinal axis, said shaft sized to fit within the jack opening, said first jack body configured to selectively move said caster with respect to said carriage frame along the longitudinal axis, wherein said first jack assembly is interchangeably coupleable to said first receiver opening and to said second receiver opening to enable a length of said carriage assembly and a width of said carriage assembly, respectively, to be selectively adjusted without requiring the scaffold to be disassembled from the carriage frame.

11. A carriage assembly in accordance with claim 10, wherein the first receiver opening is polygonal in shape.

12. A carriage assembly in accordance with claim 10, wherein at least one of said first frame member and said second frame member is fabricated from a metal material.

13. A carriage assembly in accordance with claim 10, wherein said first jack assembly further comprises an adjustment mechanism configured to move said foot along the longitudinal axis.

14. A carriage assembly in accordance with claim 13, wherein said adjustment mechanism comprises a crank.

15. A carriage assembly in accordance with claim 10 further comprising a retaining pin, wherein said jack attachment member, said first frame member, and said second frame member each includes an opening sized to receive said retaining pin.

16. A carriage assembly in accordance with claim 10 the scaffold further comprising at least one vertical scaffolding member defining a scaffolding opening, wherein said carriage assembly further comprises at least one vertical attachment member sized to fit within the scaffolding opening, said vertical attachment member coupled to at least one of said first frame member and said second frame member.

17. A carriage assembly in accordance with claim 16 further comprising at least one horizontal scaffolding member coupled to said vertical scaffolding member.

18. A carriage assembly in accordance with claim 10 further comprising a second jack assembly movable along the second axis.

* * * * *